US006557383B1

(12) United States Patent
Ito et al.

(10) Patent No.: US 6,557,383 B1
(45) Date of Patent: May 6, 2003

(54) DRUM TYPE WASHING MACHINE

(75) Inventors: Masumi Ito, Seto (JP); Fumitaka Yamazaki, Owariasahi (JP); Shinichiro Kawabata, Seto (JP); Kiyomi Sasano, Ichinomiya (JP)

(73) Assignee: Kabushiki Kaisha Toshiba, Kanagawa (JP)

( * ) Notice: Subject to any disclaimer, the term of this patent is extended or adjusted under 35 U.S.C. 154(b) by 0 days.

(21) Appl. No.: 09/700,803

(22) PCT Filed: Mar. 2, 2000

(86) PCT No.: PCT/JP00/01249

§ 371 (c)(1),
(2), (4) Date: Nov. 15, 2000

(87) PCT Pub. No.: WO00/55413

PCT Pub. Date: Sep. 21, 2000

(30) Foreign Application Priority Data

Mar. 15, 1999 (JP) ..... 11-68396

(51) Int. Cl.[7] ..... D06B 37/24

(52) U.S. Cl. ..... 68/23.2; 68/24; 68/58; 68/140

(58) Field of Search ..... 68/23 R, 23.1, 68/23.2, 24, 58, 140

(56) References Cited

U.S. PATENT DOCUMENTS

| | | | |
|---|---|---|---|
| 2,461,643 A | * | 2/1949 | Hemmeter |
| 2,893,135 A | * | 7/1959 | Smith |
| 2,995,918 A | * | 8/1961 | Neidenthal et al. |
| 3,089,326 A | * | 5/1963 | Belaieff |
| 3,509,742 A | * | 5/1970 | Bauer |
| 5,115,651 A | * | 5/1992 | Nukaga et al. |

FOREIGN PATENT DOCUMENTS

| | | | |
|---|---|---|---|
| DE | 1252618 | * | 10/1967 |
| DE | 1406884 | * | 2/1969 |
| FR | 1340648 | | 9/1963 |
| FR | 1354079 | * | 1/1964 |
| FR | 1354594 | | 1/1964 |
| FR | 2484484 | * | 12/1981 |
| FR | 2511401 | * | 2/1983 |
| GB | 1335179 | * | 6/1974 |
| GB | 139050 | * | 4/1975 |
| GB | 2 168 387 A | | 6/1986 |
| JP | 50-66973 | | 6/1975 |
| JP | 51-17373 | | 2/1976 |
| JP | 57-27434 | | 6/1982 |
| JP | 1-279893 | * | 10/1989 |
| JP | 4-220291 | | 8/1992 |
| JP | 5-84388 | | 4/1993 |
| JP | 5-131075 | | 5/1993 |
| JP | 6-7590 | | 1/1994 |
| JP | 8-215470 | | 8/1996 |
| JP | 9-253385 | | 9/1997 |
| JP | 11028298 | | 2/1999 |

* cited by examiner

*Primary Examiner*—Frankie L. Stinson
(74) *Attorney, Agent, or Firm*—Pillsbury Winthrop LLP

(57) ABSTRACT

The present invention is a drum type washing machine including an outer cabinet (1), a water tub (3) elastically supported on suspension (4A, 4B) in the outer cabinet (1), and a rotating tub (10) mounted for rotation in the water tub (3). A loading element (33) loads the suspension (4A, 4B) and has a center of gravity located between substantially the middle of a dimension from the front to the rear of the rotating tub (10) and the rear of the rotating tub (10). The loading element (33) at least includes the water tub (3), rotating tub (10), bearing assembly (14, 15, 16) and motor (17) driving the rotating tub (10).

18 Claims, 13 Drawing Sheets

DRUM TYPE WASHING MACHINE

This application is the national phase of international application PCT/JP00/01249 filed Mar. 2, 2000 which designated the U.S.

BACKGROUND OF THE INVENTION

1. Field of the Invention

The present invention provides a drum type washing machine comprising an outer cabinet, a water tub provided in the outer cabinet, a rotating tub provided for rotation in the water tub, the rotating tub having a front and a rear, an electric motor driving the rotating tub, an elastic supporting element elastically supporting the water tub, and a loading element loading the supporting element and having a center of gravity located between substantially the middle of a dimension from the front to the rear of the rotating tub and the rear of the rotating tub, wherein the elastic supporting element includes a pair of front supporting members disposed ahead of the center of gravity of the loading element and a pair of rear supporting members disposed in the rear of the center of gravity of the loading element, and a distance from each front supporting member to the center of gravity of the loading element is substantially equal to a distance from each rear supporting member to the center of gravity of the loading element.

2. Description of the Related Art

An electric motor 109 is provided on a lower portion of the water tub 102. The motor 109 includes a rotational shaft 109a on which a driving pulley 110 is mounted. A transmission belt 112 extends between the pulleys 110 and 108. The pulleys 108 and 110 and the belt 112 constitute a belt transmission mechanism 111. In the above-described construction, torque developed by the motor 109 is transmitted via the belt transmission mechanism 111 to the rotating tub 104 so that the tub is rotated.

In the drum type washing machines such as described above, vibration or oscillation generally tends to be produced during a dehydrating or spinning operation since laundry stuck to the inner circumferential face of the rotating tub 104 is raised against gravity. For reduction in the vibration, counterbalances 113 and 114 are mounted on upper and lower front portions respectively so that load is uniformly applied to the suspension mechanisms 103 and so that weight distribution with respect to the center of rotation of the rotating tub 104 is well balanced.

However, an amount of load received by each suspension mechanism 103 is varied due to an amount of the laundry accommodated in the rotating tub or the weight distribution with respect to the center of rotation during the washing or dehydrating operation. As a result, a sufficient amount of vibration due to rotation of the rotating tub 104 cannot be reduced. Thus, a further improvement is desired.

SUMMARY OF THE INVENTION

Therefore, an object of the present invention is to provide a drum type washing machine in which the vibration due to rotation of the rotating tub can effectively be reduced.

The present invention provides a drum type washing machine comprising an outer cabinet, a water tub provided in the outer cabinet, a rotating tub provided for rotation in the water tub, the rotating tub having a front and a rear, an electric motor driving the rotating tub, an elastic supporting element elastically supporting the water tub, and a loading element loading the supporting element and having a center of gravity located between substantially the middle of a dimension from the front to the rear of the rotating tub and the rear of the rotating tub, wherein the elastic supporting element includes a pair of front supporting members disposed ahead of the center of gravity of the loading element and a pair of rear supporting members disposed in the rear of the center of gravity of the loading element, and a distance from each front supporting member to the center of gravity of the loading element is substantially equal to a distance from each rear supporting member to the center of gravity of the loading element.

There are several causes for the vibration due to rotation of the rotating tub. The inventors noted one of such causes, that is, a location of the center of gravity of a member (a loading element) loading the elastic supporting element. The inventors carried out an experiment to confirm the relationship between the location of the center of gravity of the loading element and occurrence of vibration. The experiment shows that the vibration is reduced when the center of gravity of the loading element is located between substantially the middle of a back-and-forth dimension from the front to the rear of the rotating tub and the rear of the rotating tub. The above-described construction can reduce the vibration and noise produced during rotation of the rotating tub. Further, the water tub can stably be supported on the two pairs of the supporting members disposed ahead of and in the rear of the center of gravity of the loading element. Moreover, since the load of the loading element is applied uniformly to the supporting members, the vibration due to rotation of the rotating tub can be reduced.

The drum type washing machine preferably further comprises a bearing assembly provided on the rear of the water tub for supporting the rotating tub for rotation. In this case, the loading element includes at least the water tub, rotating tub, bearing assembly and motor. Each of the water tub, rotating tub, bearing assembly and motor contributes to the center of gravity of the loading element since each of them has a relatively large weight. Accordingly, when the weights of these parts and locational relations among these parts are adjusted during the manufacture, the center of gravity of the loading element can be set at a suitable location.

Either the water tub or the rotating tub is preferably provided with a counterweight disposed ahead of substantially the middle of the dimension from the front to the rear of the rotating tub. A location and weight of the counterweight are adjusted such that the center of gravity of the loading element can easily be set at a suitable location.

The elastic supporting element preferably includes a pair of front supporting members disposed ahead of the center of gravity of the loading element and a pair of rear supporting members disposed in the rear of the center of gravity of the loading element, and a distance from each front supporting member to the center of gravity of the loading element is substantially equal to a distance from each rear supporting member to the center of gravity of the loading element. Consequently, the water tub can stably be supported on the two pairs of the supporting members disposed ahead of and in the rear of the center of gravity of the loading element. Moreover, since the load of the loading element is applied uniformly to the supporting members, the vibration due to rotation of the rotating tub can be reduced.

The elastic supporting element preferably includes a pair of front supporting members disposed ahead of the center of gravity of the loading element and a pair of rear supporting members disposed in the rear of the center of gravity of the loading element, and a distance from each front supporting member to the center of gravity of the loading element is substantially longer than a distance from each rear supporting member to the center of gravity of the loading element. Since a distance or span between the two pairs of the supporting members supporting the water tub is increased, the water tub can further stably be supported.

The load of the loading element is applied non-uniformly to the front and rear supporting members when the distance from the center of gravity of the loading element to each front supporting member differs from the distance from the center of gravity of the loading element to each rear supporting member. To solve the problem, the drum type washing machine preferably further comprises a first fixing member to which the front supporting member is fixed and a second fixing member to which the rear supporting member is fixed. In this construction, a mounting dimension from the first fixing member to a portion of each front supporting member on which the water tub is supported differs from a mounting dimension from the second fixing member to a portion of each rear supporting member on which the water tub is supported. Even when the load applied to each front supporting member differs from the load applied to each rear supporting member, the mounting dimension of each front supporting member differs from that of each rear supporting member such that the inclination of the loading element or the water tub can be adjusted.

Each front supporting member preferably includes a first spring to which the load of the loading element is applied, each rear supporting member includes a second spring to which the load of the loading element is applied, and each first spring has a free length differing from a free length of each second spring. In this construction, the free length of each first spring is set at a suitable value differing from that of the free length of each second spring such that the inclination of the water tub can be adjusted.

Each front supporting member preferably includes a first spring to which the load of the loading element is applied, each rear supporting member includes a second spring to which the load of the loading element is applied, and each first spring has a spring constant differing from a spring constant of each second spring. Consequently, the spring constants of the first and second springs are set at suitable values respectively so that the inclination of the water tub can be adjusted.

The invention also provides a drum type washing machine comprising an outer cabinet, a water tub provided in the outer cabinet, a drum type rotating tub provided for rotation in the water tub, the rotating tub having a front and a rear, an electric motor driving the rotating tub, an elastic supporting element elastically supporting the water tub, and a loading element loading the supporting element and having a center of gravity located between substantially the middle of a dimension from the front to the rear of the rotating tub and the rear of the rotating tub. In this construction, the elastic supporting element includes a pair of the elastic supporting elements including respective portions on which the water tub is supported, the portions being located ahead of the center of gravity of the loading element between the center of gravity of the loading element and another center of gravity of the loading element in a case where an allowable maximum amount of laundry is accommodated in the rotating tub.

The drum type washing machine generally performs a drying operation as well as the washing and dehydrating operations. A maximum amount of laundry to be dried in one drying operation is about one half of a maximum amount of laundry to be washed and dehydrated, that is, a maximum amount of laundry allowed to be accommodated in the rotating tub. Amounts of vibration and noise produced during the dehydrating operation are larger than during the washing and drying operations since the rotating tub is rotated at high speeds in the dehydrating operation. The inventors then regarded substantially one half of the maximum amount of laundry allowed to be accommodated in the rotating tub as a standard amount of laundry. Consequently, since the water tub can stably be supported by the elastic supporting element when the standard amount of laundry is dehydrated, the vibration and noise can effectively be reduced.

The drum type washing machine preferably further comprises a limiting element which limits a back-and-forth movement of the water tub. Consequently, the back-and-forth movement of the water tub which tends to result from the support of the water tub by the paired elastic supporting members can be limited.

The drum type washing machine preferably further comprises a balancer provided on the front of the rotating tub. This construction can prevent the rotating tub from being rotated with a swinging motion, thereby reducing the vibration and noise.

The rotating tub preferably has a rotation axis inclined rearwardly downward relative to a horizontal axis. In this construction, the laundry accommodated in the rotating tub are located deep in the tub such that the laundry is not displaced so much. Accordingly, the center of gravity of the loading element is not shifted so much and the balance of weight is difficult to lose. Consequently, the water tub can stably be supported by the elastic supporting element.

DETAILED DESCRIPTION OF THE INVENTION

Figure 1:
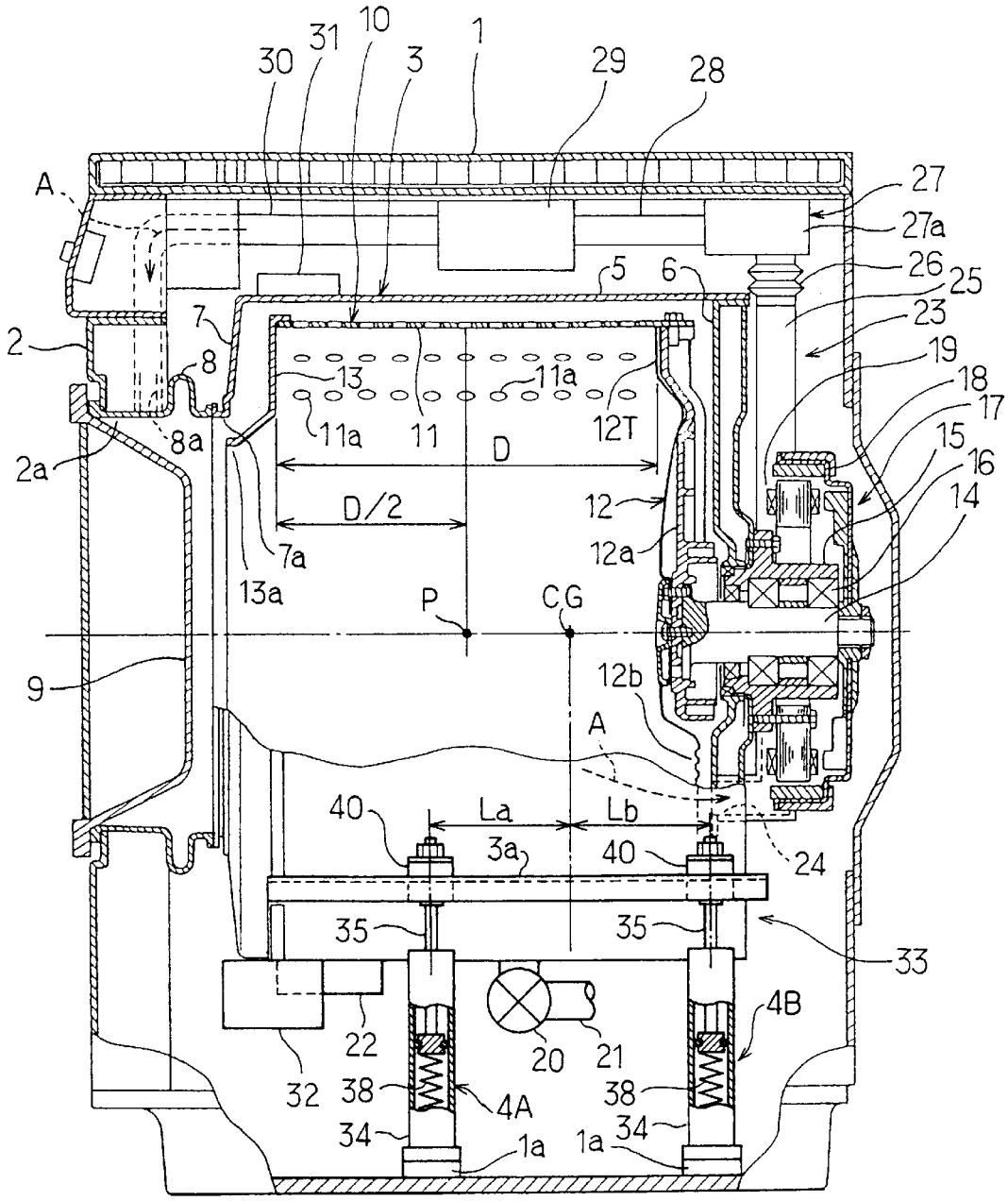
FIG. 1 is a longitudinally sectional side view of a drum type washing machine of a first embodiment in accordance with the present invention.
Figure 2:
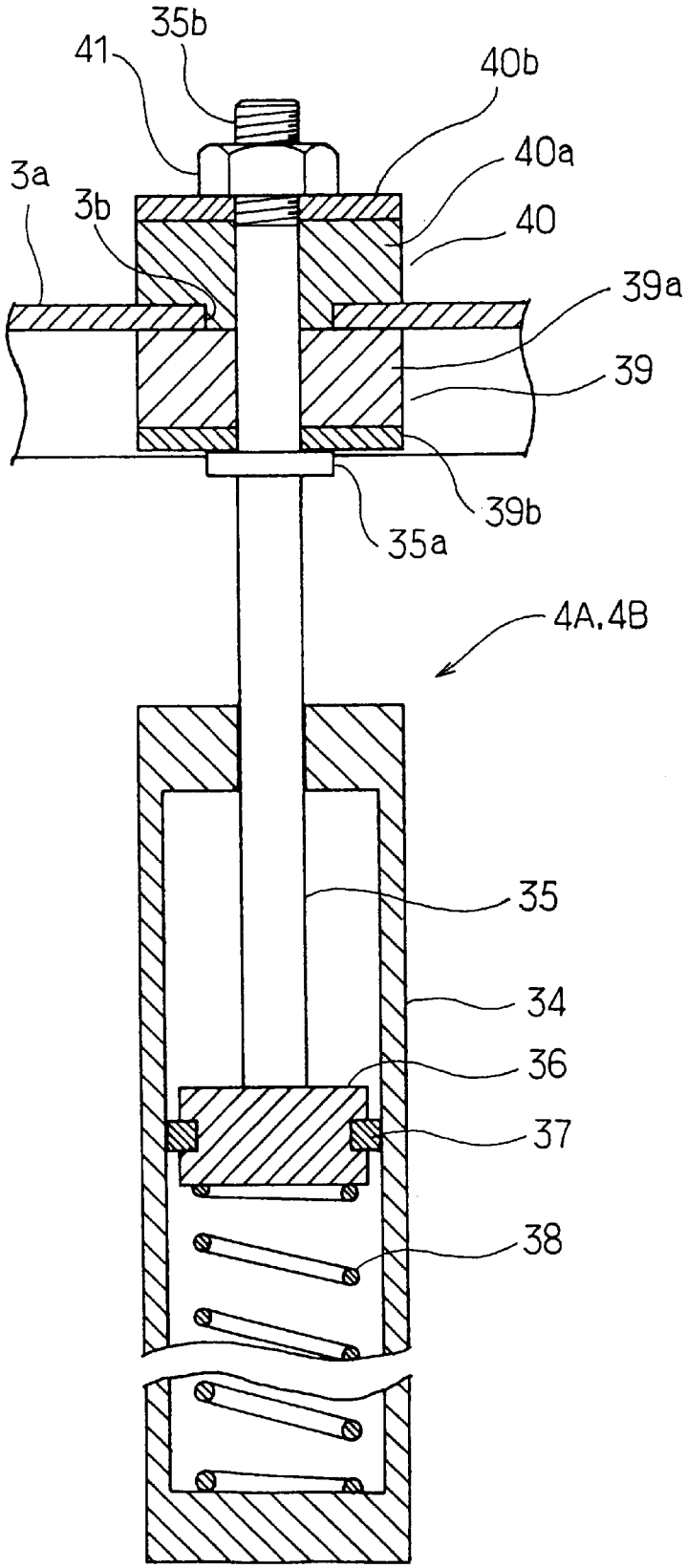
FIG. 2 is an enlarged longitudinal section of a suspension mechanism.

Several embodiments of the present invention will be described with reference to the accompanying drawings. Referring to FIGS. 1 and 2, a drum type washing machine of a first embodiment is shown. The washing machine is provided with a drying function. The washing machine comprises an outer cabinet 1 formed into the shape of a generally rectangular box. The cabinet 1 includes a front 2 having a substantially centrally formed access opening 2*a* through which laundry is put into and taken out of a rotating tub. A door 9 closing and opening the access opening 2*a* is mounted on the front 2 of the cabinet 1. The cabinet 1 encloses a cylindrical water tub 3 therein. The water tub 3 includes a body 5, a rear wall 6 and a front wall 7 each of which is made of a metal.

A pair of longitudinally extending supports 3*a* are fixed to a lower portion of the body 5 of the water tub 3. The supports 3*a* are spaced from each other. A pair of mounts 1*a* are secured to the front bottom of the cabinet 1. Another pair of mounts 1*b* are further secured to the rear bottom of the cabinet 1. A pair of front suspension mechanisms 4A serving as front supporting elements stand on the mounts 1*a* respectively. The front suspension mechanisms 4A have upper ends mounted to front portions of the supports 3*a* respectively. A pair of rear suspension mechanisms 4B serving as rear supporting elements stand on the mounts 1*b* respectively. The rear suspension mechanisms 4B have upper ends mounted to rear portions of the supports 3*a* respectively. The front and rear suspension mechanisms 4A and 4B constitute an elastic supporting element. The water tub 3 is elastically supported on the bottom of the casing 1 by the front and rear suspension mechanisms 4A and 4B. The mounts 1*a* serve as first fixing members, whereas the mounts 1*b* serve as second fixing members, respectively.

FIG. 2 shows the construction of each of the suspension mechanisms 4A and 4B. The suspension mechanisms 4A and 4B have the same construction. Each suspension mechanism comprises a cylinder 34 and a rod 35 having a lower portion inserted into the cylinder. The rod 35 includes a rod head 36 formed on a lower end thereof. A sliding ring 37 made of rubber, for example, is attached to an outer circumference of the rod head 36. The sliding ring 37 slides on an inner circumferential surface of the cylinder 34 when rod 35 is vertically moved. A compression coil spring 38 is provided under the rod head 36 in the cylinder 34.

The rod 35 has a threaded portion 35b formed on an upper end thereof. The rod 35 further has a holding flange 35*a* spaced from the threaded portion 35*b*. A pair of mounts 39 and 40 are provided between the threaded portion 35*b* and the flange 35*a*. Each mount comprises a rubber cushion 39*a*, 40*a* and a metal plate 39*b*, 40*b*. The upper portion of the rod 35 is inserted through a hole 3*b* formed through the support 3*a*. The support 3*a* is held between the cushions 39*a* and 40*a*, and a nut 41 is screwed down on the threaded portion 35*b*, whereby the suspension mechanisms 4A and 4B are mounted on the support 3*a*. The front wall 7 has a generally circular opening 7*a* as shown in FIG. 1. A generally cylindrical elastic member or bellows 8 made of rubber, for example, connect the opening 7*a* and the access opening 2*a* together.

A rotating tub 10 is rotatably mounted in the water tub 3. The rotating tub 10 includes a body 11, a rear wall 12 and a front wall 13 each of which is made of a metal. The body 11 has a number of perforations la and the front wall 13 has a generally circular opening 13*a*. The rear wall 12 has a plurality of vent holes (not shown). A rotating tub support 12*a* is secured to a rear side of the rear wall 12. A rotating tub shaft 14 serving as a rotational shaft is fixed to a rear side of the rear wall 12 so as to protrude rearward.

A bearing housing 15 is fixed to a substantially central rear wall 5 of the water tub 13 so that a front end of the bearing housing 15 extends through the rear wall 6. A bearing 16 is enclosed in the bearing housing 15. The rotating tub shaft 14 is rotatably mounted on the bearing 16. Thus, the shaft 14, the bearing housing 15 and the bearing 16 constitute a bearing assembly. Further, a stator 19 of a brushless motor 17 of the outer rotor type is fixed to an outer circumference of the bearing housing 15. A rotor 18 also constituting the brushless motor is fixed to a rear end of the shaft 14. The rotating tub 10 is directly driven by the motor 17.

A drain hole (not shown) is provided in the bottom of the water tub 3. A drain valve 20 and a flexible drain hose 21 are connected to the drain hole. The drain valve 20 is opened and closed by a drain valve motor (not shown). A water-supply valve supplying water into the water tub 3 and a flexible hose connected to the water-supply valve are provided in an upper interior of the cabinet 1. A heater 22 is further mounted on the bottom of the water tub 3. The heater 22 comprises a sheathed heater (not shown) provided in a recess (not shown) which is formed on the lower portion of the body 5 so as to outwardly protrude. Water in the water tub 3 is heated by the heater 22 into warm water.

A warm air supplier 23 is provided in the upper rear interior of the cabinet 1. The warm air supplier 23 comprises a heat exchanger 25, a fan 27 and a heater 29. The heat exchanger 25 is provided in the rear of the water tub 3. The fan 27 includes a casing 27*a* and fan blades (not shown) enclosed in the casing. The fan 27 is mounted on the inner face of the outer casing 1 so as to be located in the upper rear interior of the casing. The heater 29 is mounted on the inner face of the top of the casing 1 so as to be located substantially in the middle of a depth of the casing. The rear wall 6 of the water tub 3 is formed with a hot air return port 24. One of two ends of the heat exchanger 25 is connected to the port 24. The other end of the heat exchanger 25 is connected via an accordion connecting duct 26 to a suction side of the fan 27. A duct 28 connects an exhaust side of the fan 27 to the heater 29. The bellows 8 are formed with a hot air exhaust port 8*a* to which the heater 29 is connected via a duct 30.

Upon drive of the hot air supplier 23 in the drying operation, air in the rotating tub 10 is drawn through the return port 24 into the heat exchanger 25 as shown by arrow A in FIG. 1. The drawn air is returned through the connecting duct 26, the fan 27, the duct 28, the heater 29, the duct 30 and the exhaust port 8*a* into the rotating tub 10. As the result of such air circulation, the air in the rotating tub 10 is warmed and dehumidified by heat exchange, whereupon laundry in the tub is dried.

Two counterweights 31 and 32 are mounted on the front upper and lower portions of the water tub 3. The weights and positions of the counterweights 31 and 32 are previously set so that the center of gravity of a member for applying load to the suspension mechanisms 4A and 4B or the loading element 33 is located between substantially the middle of a dimension from the front wall to the rear wall of the rotating tub 10 and the rear wall 12 of the rotating tub 10, or more specifically, between the middle P of the back-and forth dimension from the front wall to the rear wall of the rotating tub 10 and a portion 12T of the rear wall 12 of the rotating tub 10. The aforesaid middle P is a location spaced from an inner circumferential face of the front wall 13 by about D/2 where D is a distance between the inner circumferential face of the front wall 13 and the portion 12T.

The loading element 33 will now be described. The suspension mechanisms 4A and 4B support the water tub 3 on the lower portion thereof. Accordingly, the suspension mechanisms 4A and 4B are subjected to a load of the water tub 3 and a load of a member directly or indirectly on the water tub 3. More specifically, the suspension mechanisms 4A and 4B are subjected to the loads of the water tub 3, the rotating tub 10, the rotational shaft 14, the bearing housing 15, the bearing 16, the motor 17, the drain valve 20, the heater 22, the heat exchanger 25 and the counterweights 31 and 32. These members thus constitute the loading element 33. The load of the loading element 33 is received by the springs 38 of the suspension mechanisms 4A and 4B and is further received by a frictional force between the sliding ring 37 and the inner circumferential face of the cylinder 34.

The center of gravity CG of the loading element 33 is set in the following manner. First, a preparatory center of gravity of the loading element 33 excluding the counterweights 31 and 32 is obtained. Each of the water tub 3, rotating tub 10, bearing assembly including the shaft 14, bearing housing 15 and the bearing 16, and motor 17 particularly have large weights respectively and occupy a large part of the loading element 33. Accordingly, the location of the preparatory center of gravity is roughly obtained on the basis of the weights and locations of the aforesaid components. Since the motor 17 is disposed in the rear of the water tub 3 in the embodiment, the preparatory center of gravity is located near the rear wall of the water tub 3. Then, the weights and locations of the counterweights 31 and 32 are adjusted so that the center of gravity CG of the loading element 33 is located between the middle P and the portion 12T. In the embodiment, the center of gravity CG of the loading element 33 is located substantially in the middle of the section between the point P and the portion 12T.

The front and rear suspension mechanisms 4A and 4B are disposed with the center of gravity CG of the loading element 33 being interposed therebetween. Reference symbol La designates a distance between the mounting position of the front suspension mechanism 4A on the support 3 and the center of gravity CG. Reference symbol Lb designates a distance between the mounting position of the rear suspension mechanism 4B on the support 3 and the center of gravity CG. Particularly in the embodiment, the distances La and Lb are set to be substantially equal to each other. That is, the center of gravity CG is spaced from the mounting positions by the distances La and Lb respectively as shown in FIG. 1.

The operation of the drum type washing machine will be described. In the washing operation, the motor 17 is rotated at a relatively low speed intermittently in the normal and reverse directions so that the rotating tub 10 is rotated intermittently in the normal and reverse directions. In the dehydrating operation, the motor 17 is rotated at high speeds so that the rotating tub 10 is rotated at the high speeds. Since the center of gravity CG of the loading element 33 is located between the center P and the rear end face 12T, the balance of the rotating tub 10 during rotation is improved such that the vibration can be reduced.

Further, the suspension mechanisms 4A and 4B are located in front and in the rear of the center of gravity of loading element 33. Consequently, the loading element 33 can stably be held. Particularly in the embodiment, the distance from the center of gravity CG to the front suspension mechanism 4A and the distance from the center of gravity CG to the rear suspension mechanism 4B are set to be substantially equal to each other. Accordingly, the load of the loading element 33 is applied uniformly to both suspension mechanisms 4A and 4B. Consequently, the loading element 33 can stably be held on the suspension mechanisms 4A and 4B, whereupon the vibration can further be reduced.

Figure 3:
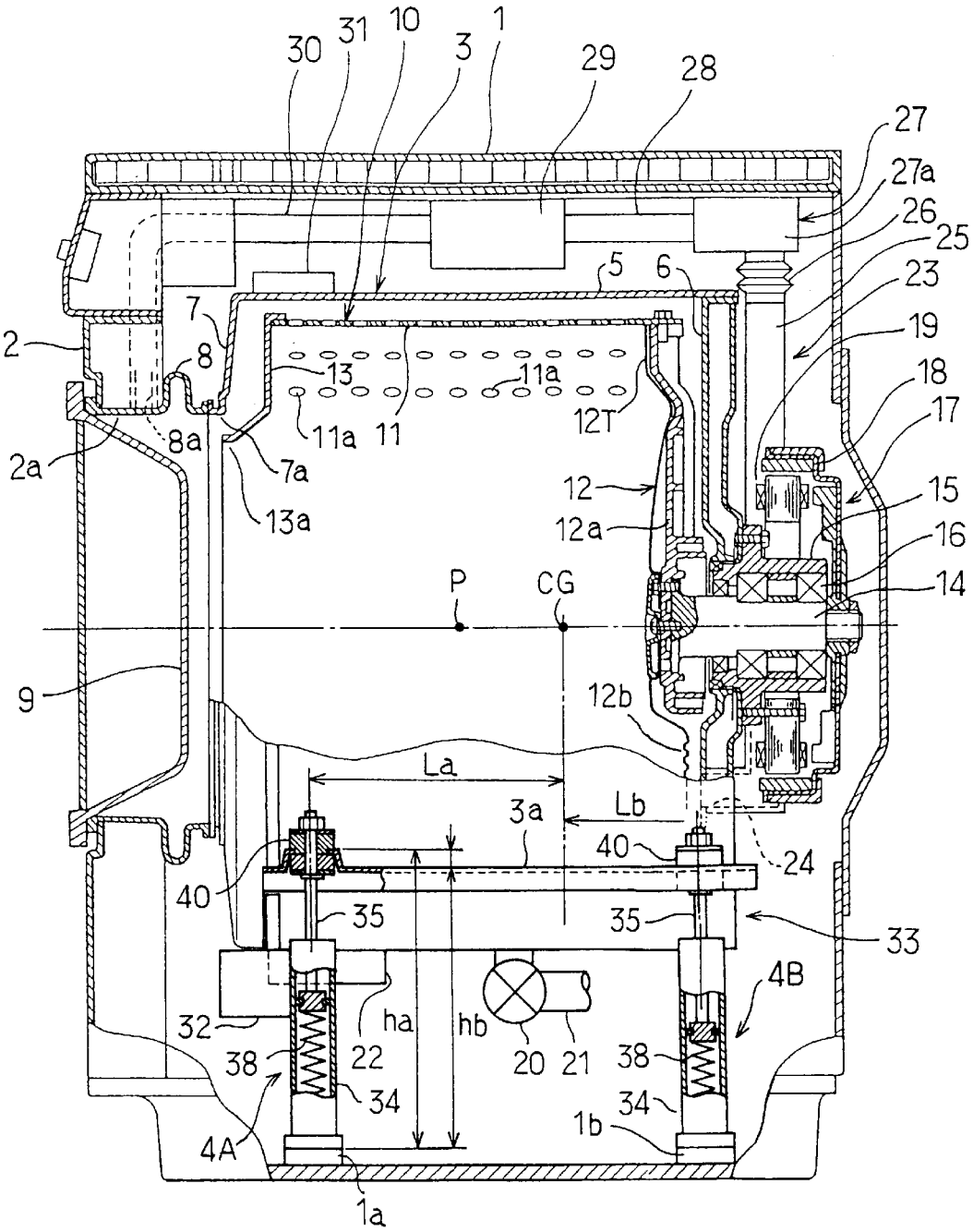
FIG. 3 is a view similar to FIG. 1, showing the drum type washing machine of a second embodiment in accordance with the invention.
Figure 4:
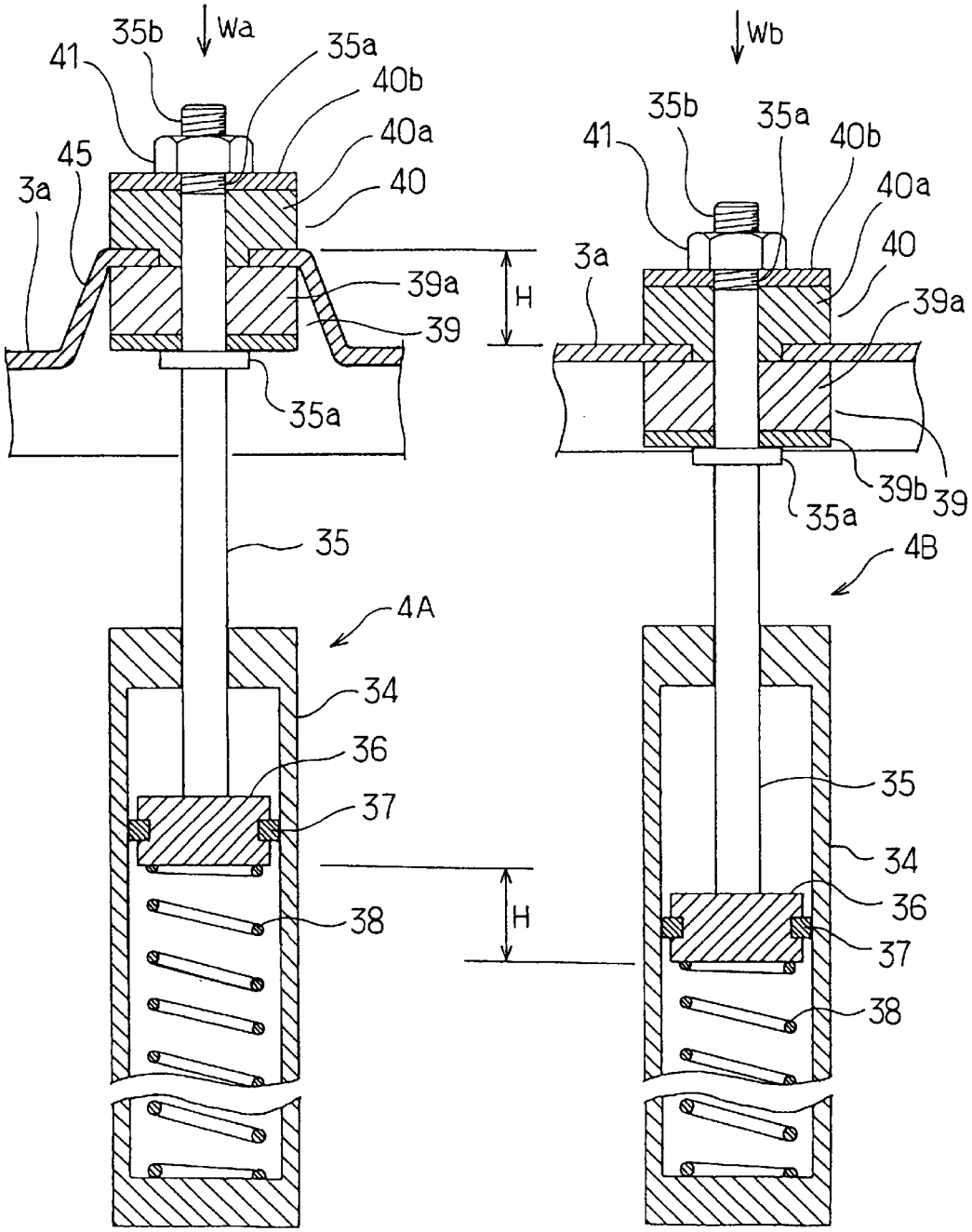
FIG. 4 is a longitudinal section of front and rear suspension mechanisms.

FIGS. 3 and 4 illustrate a second embodiment of the invention. The differences between the first and second embodiments will be described. The identical or similar parts in the second embodiment are labeled by the same reference symbols as in the first embodiment. In the second embodiment, the distance La from the center of gravity to the front suspension mechanism 4A is set to be larger than the distance Lb from the center of gravity CG to the rear suspension mechanism 4B. The support 3*a* has an upwardly protruding concavity 45 formed on a portion thereof to which the front suspension mechanism 4A is mounted. Reference symbol H designates a dimension of the protruding portion of the concavity 45 as shown in FIG. 3. Accordingly, a distance ha from the mount 1*a* to a location where the front suspension mechanism 4A supports the water tub 3 is longer by the length H than a distance hb from the mount 1*b* to a location where the rear suspension mechanism 4B supports the water tub 3.

In the first embodiment, the distance from the front suspension mechanism 4A to the center of gravity CG of the loading element 33 is rendered equal to the distance from the rear suspension mechanism 4B to the center of gravity CG of the loading element 33 so that the loads applied to the respective suspension mechanisms 4A and 4B are equalized. However, since the center of gravity CG of the loading element 33 is located in the rear of the center P, the distance (La+Lb) between the front and rear suspension mechanisms 4A and 4B is shorter than the depth or the dimension between the front and rear walls of the water tub 3. As a result, the supporting of the water tub 3 by the suspension mechanisms 4A and 4*b* is reduced in the stability. In the second embodiment, however, the front and rear suspension mechanisms 4A and 4B support the water tub 3 at the front and rear ends. This increases a distance or span between both suspension mechanisms 4A and 4B. Consequently, the loading element 33 can be supported further stably.

The distance from the front suspension mechanism 4A to the center of gravity CG of the loading element 33 differs from the distance from the rear suspension mechanism 4*b* to the center of gravity CG of the loading element 33 in the second embodiment. Accordingly, the loads applied to both suspension mechanisms 4A and 4B respectively are unequal to each other. More specifically, the load (Wa) applied to the front suspension mechanism 4A is smaller than the load (Wb) applied to the rear suspension mechanism 4B (Wa<Wb). As a result, an amount of flexure of the spring 38 of the front suspension mechanism 4A when the distances ha and hb are equal to each other and the load applied to the spring 38 of the front suspension mechanism 4A is smaller than the load applied to the spring 38 of the rear suspension mechanism 4B. Consequently, the loading element 33 or the water tub 3 is inclined rearwardly downward. The difference in the amounts of flexure corresponds to the dimension of the protruding portion of the concavity 45.

In the second embodiment, however, the distance ha of the front suspension mechanism 4A is set to be smaller by the length H than the distance hb of the rear suspension mechanism 4B. Consequently, the loading element 33 or the water tub 3 can be held substantially in the horizontal state by the suspension mechanisms 4A and 4B.

Figure 5:
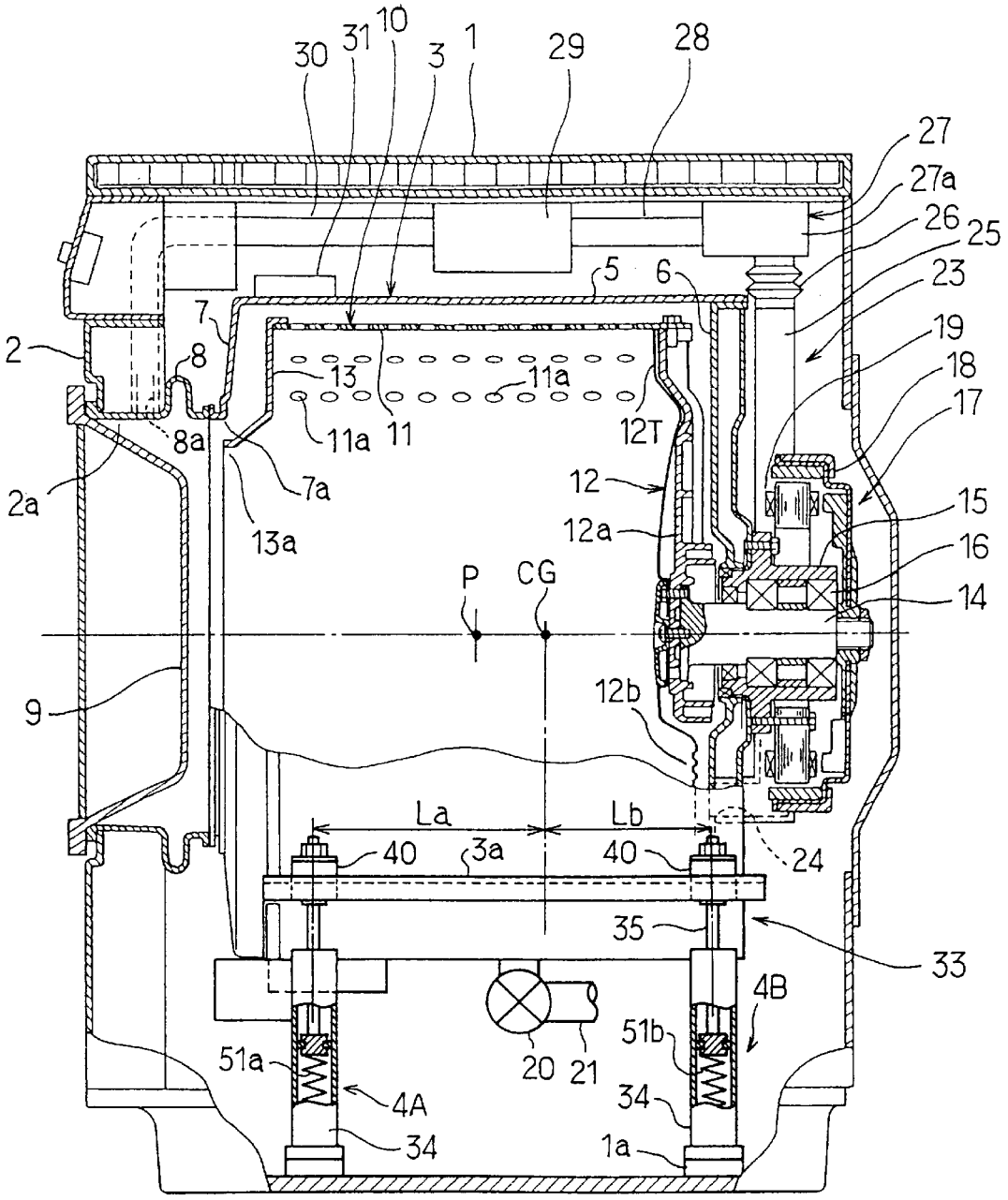
FIG. 5 is a view similar to FIG. 1, showing the drum type washing machine of a third embodiment in accordance with the invention.
Figure 6A:
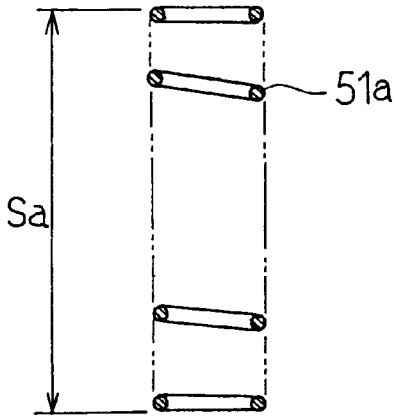
FIGS. 6A and 6B are schematic views of the springs of the front and rear suspension mechanisms for the comparison of the lengths in the free state, respectively.
Figure 6B:
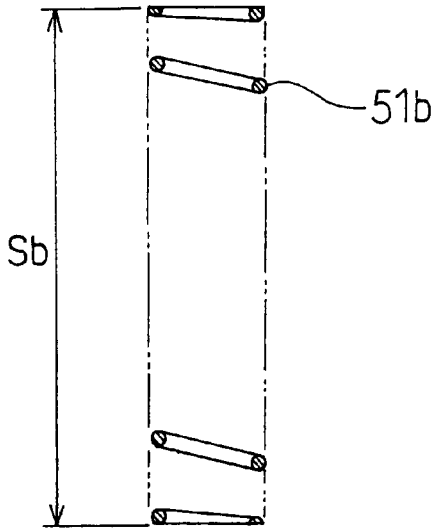
Figure 7A:
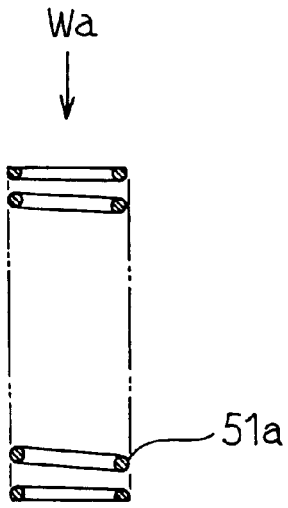
FIGS. 7A and 7B are schematic views of the springs of the front suspension mechanism subjected to load Wa and the rear suspension mechanism subjected to load Wb for the comparison of the loaded states.
Figure 7B:
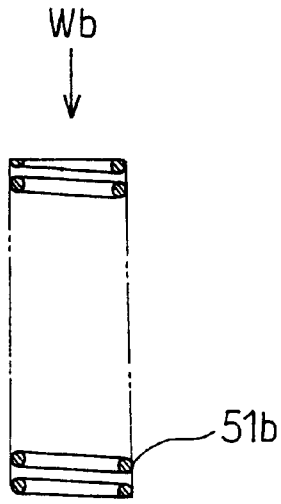

FIGS. 5 to 7 illustrate a third embodiment of the invention. The difference between the second and third embodiments will be described. The distances ha and hb differ from each other in the second embodiment. In the third embodiment, the front and rear suspension mechanisms 4A and 4B have constructions differing from each other, instead. More specifically, the front suspension mechanism 4A includes a first compression coil spring 51*a* instead of the spring 38, whereas the rear suspension mechanism 4B includes a second compression coil spring 51*b* instead of the spring 38. The first and second compression coil springs 51*a* and 51*b* have the same spring constant and free lengths different from each other. Thus, the free length Sb of the second compression coil spring 51*b* is larger than the free length Sa of the first compression coil spring 51*a* as shown in FIGS. 6A and 6B. Both free lengths Sa and Sb are set according to the loads Wa and Wb applied to the suspension mechanisms 4A and 4B respectively. In other words, the free lengths Sa and Sb are set so that the lengths of the springs 51*a* and 51*b* equal to each other when the loads Wa and Wb are applied to the front and rear suspensions 4A and 4B respectively, as shown in FIGS. 7A and 7B. Consequently, the water tub 3 can be held substantially in the horizontal state by the suspension mechanisms 4A and 4B.

Figure 8:
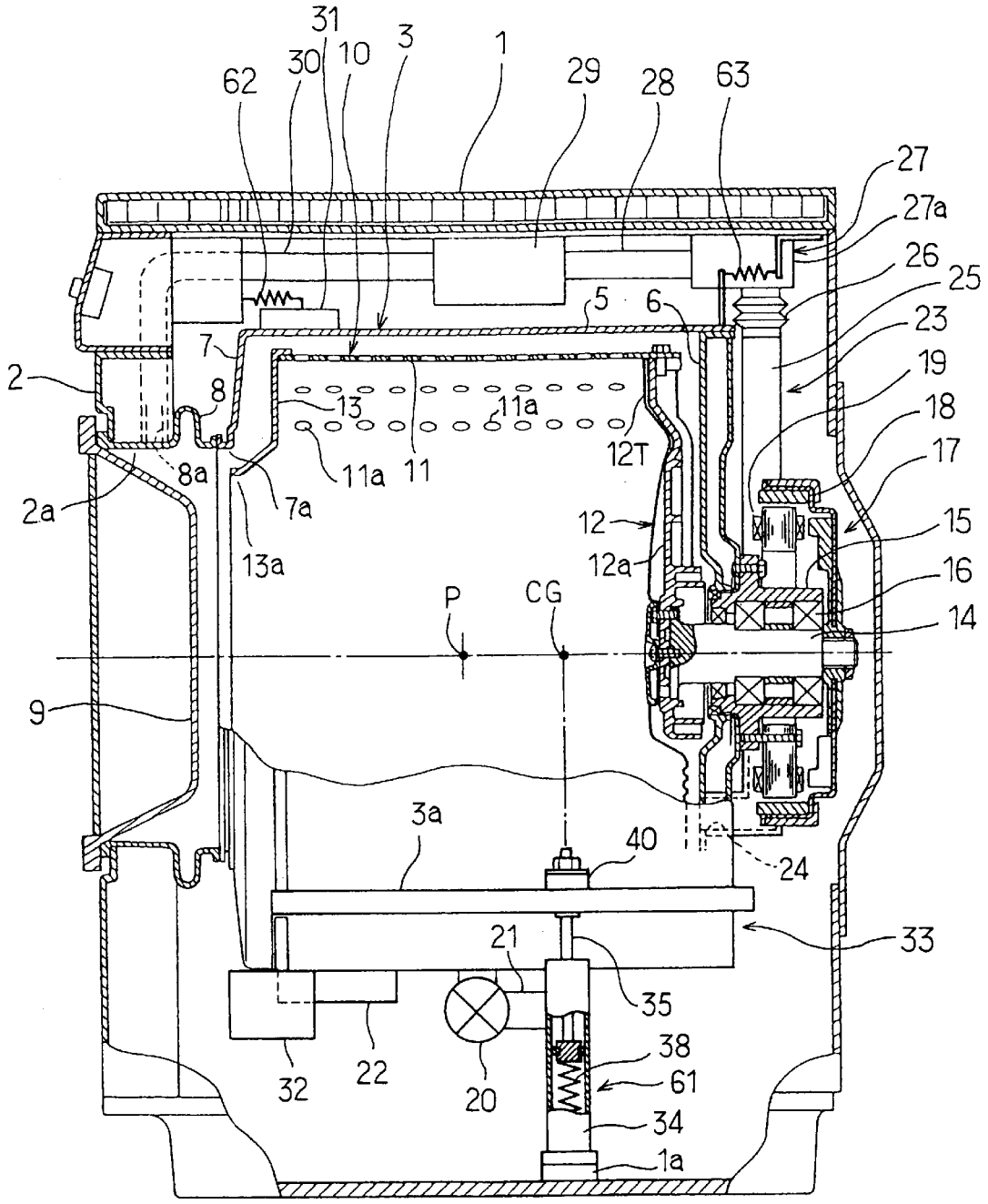
FIG. 8 is a view similar to FIG. 1, showing the drum type washing machine of a fourth embodiment in accordance with the invention.

FIG. 8 illustrates a fourth embodiment of the invention. Only the difference between the first and fourth embodiments will be described. In the fourth embodiment, a single pair of suspension mechanisms 61 serving as the elastic supporting element are provided on the right and left sides of the water tub 3 respectively so as to correspond substantially to the center of gravity of the loading element 33. Each suspension mechanism 61 has the same construction as each of the suspension mechanisms 4A and 4B in the first embodiment.

Two tension springs 62 and 63 serving as limiting elements are provided in the cabinet 1. The tension spring 62 has two ends connected to the front top of the water tub 3 and the inner face of the cabinet 1 respectively. The tension spring 63 has two ends connected to the rear top of the water tub 3 and the inner face of the cabinet 1 respectively. The tension springs 62 and 63 limit the back-and-forth movement of the water tub 3.

According to the fourth embodiment, the weight balance of the loading element 33 with respect to the center of gravity CG thereof is not reduced even through the water tub 3 is supported by a pair of suspension mechanisms 61. Consequently, the vibration of the water tub 3 during rotation of the rotating tub 10 can be reduced. Furthermore, since the swing of the water tub 3 is reduced by the springs 62 and 63, amounts of vibration and noise can be reduced during rotation of the rotating tub 10.

Figure 9:
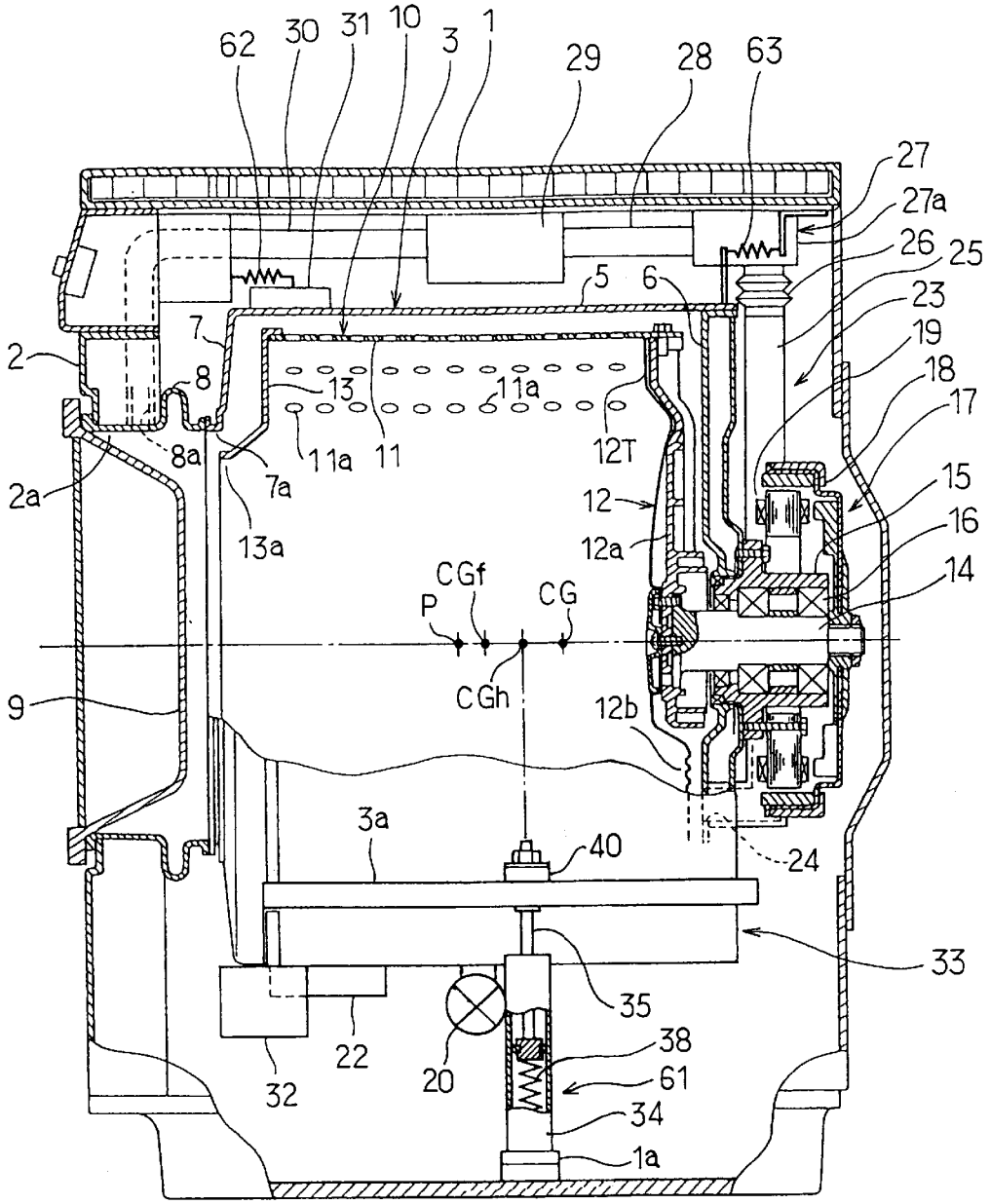
FIG. 9 is a view similar to FIG. 1, showing the drum type washing machine of a fifth embodiment in accordance with the invention.

FIG. 9 illustrates a fifth embodiment of the invention. Only the difference between the fourth and fifth embodiments will be described. In the fifth embodiment, the suspension mechanisms 61 are disposed ahead of the center of gravity CG of the loading element 33. More specifically, reference symbol CGf designates the center of gravity of the loading element 33 when an allowable maximum amount of laundry is accommodated in the rotating tub 10. Reference symbol CGh designates the center of gravity of the loading element 33 when one half of the allowable maximum amount of laundry is accommodated in the rotating tub 10 at a dehydration efficiency of about 50%. In this case, each suspension mechanism 61 is disposed so as to be positioned between the center of gravity CG and the center of gravity CGf of the loading element 33 or so as to correspond substantially to the center of gravity CGh.

When accommodated in the rotating tub 10, laundry is usually located in the middle of the interior thereof. Accordingly, when the laundry has been accommodated in the rotating tub 10, the center of gravity of the loading element 33 is moved slightly forward relative to the center of gravity CG before accommodation of the laundry. An amount of movement becomes maximum when the allowable maximum amount of laundry is accommodated in the rotating tub 10. In view of this, the supporting point of each suspension mechanism 61 is located between the center of gravity CG and the center of gravity CGh.

An allowable amount of laundry is one half of the maximum amount when the washing, dehydrating and drying operations are sequentially carried out. Thus, one half of a maximum capacity is regarded as a standard amount of laundry. Furthermore, a large vibration tends to be produced and the noise becomes maximum in the dehydrating operation wherein the rotating tub 10 is rotated at high speeds. In view of the foregoing, the support point of each suspension mechanism 61 for the water tub 3 is located so as to correspond substantially to the center of gravity CGh in the embodiment. Consequently, an amount of vibration can be reduced when the washing, dehydrating and drying operations are sequentially carried out or particularly when the dehydrating operation is carried out.

Figure 10:
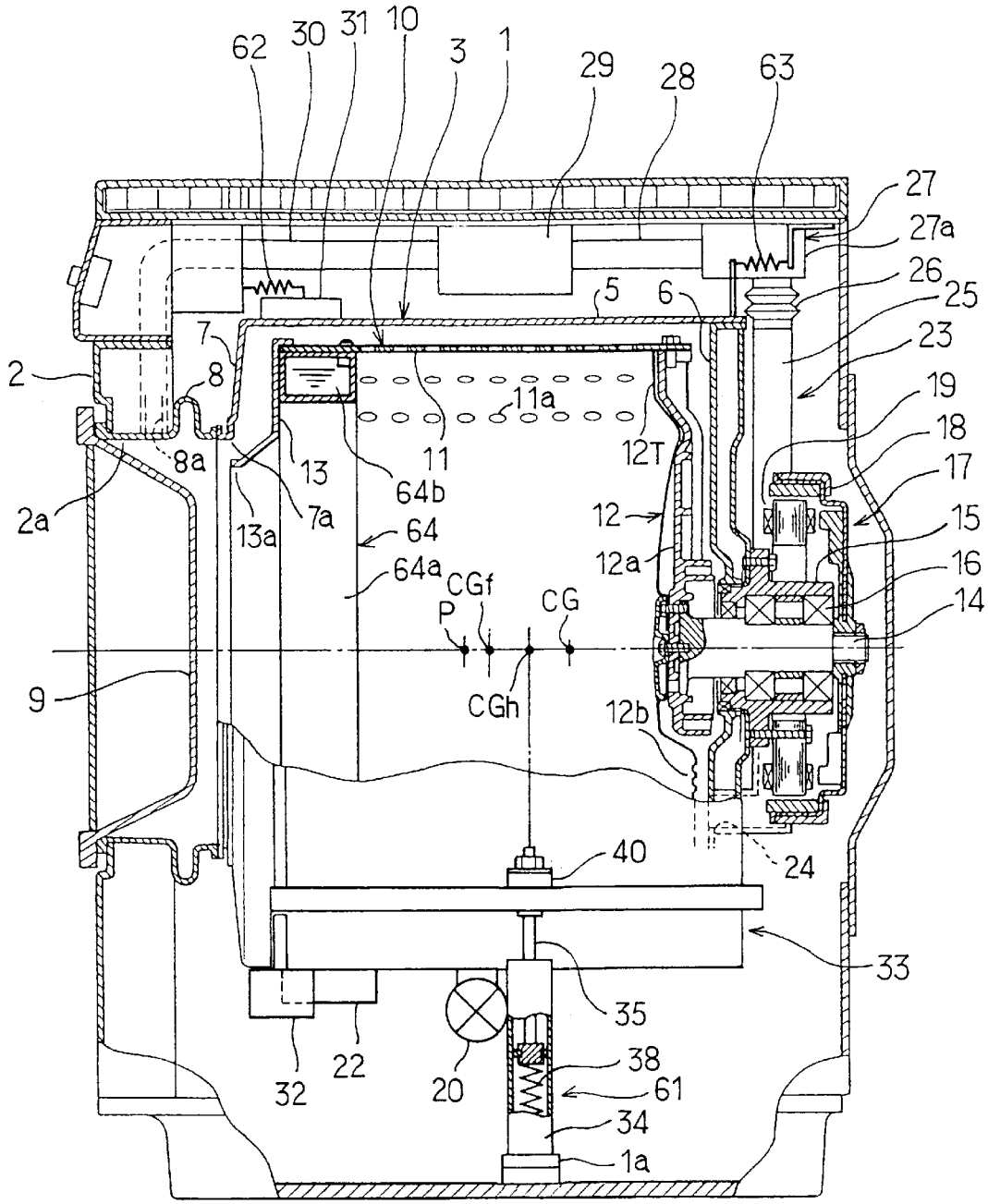
FIG. 10 is a view similar to FIG. 1, showing the drum type washing machine of a sixth embodiment in accordance with the invention.

FIG. 10 illustrates a sixth embodiment of the invention. The sixth embodiment differs from the fifth embodiment in that a balancer 64 is provided on the front of the rotating tub 10. The balancer 64 comprises a container 64*a* and a predetermined amount of liquid or for example, water 64*b* filling the container and serving as a fluid. The container 64*a* is formed into an annular shape and has an interior divided into a number of chambers communicating with one another although the interior of the container is not shown. The balancer 64 serves as a component constituting the loading element 33. Accordingly, the weights of the counterweights 31 and 32 are set in view of the weight of the balancer 64.

According to the sixth embodiment, provision of the balancer 64 can prevent the rotating tub 10 from being rotated with a swinging motion, thereby reducing the vibration and noise. Furthermore, the balancer 64 serves as a member for adjusting the location of the center of gravity CG of the loading element 33 together with the counterweights 31 and 32.

Figure 11:
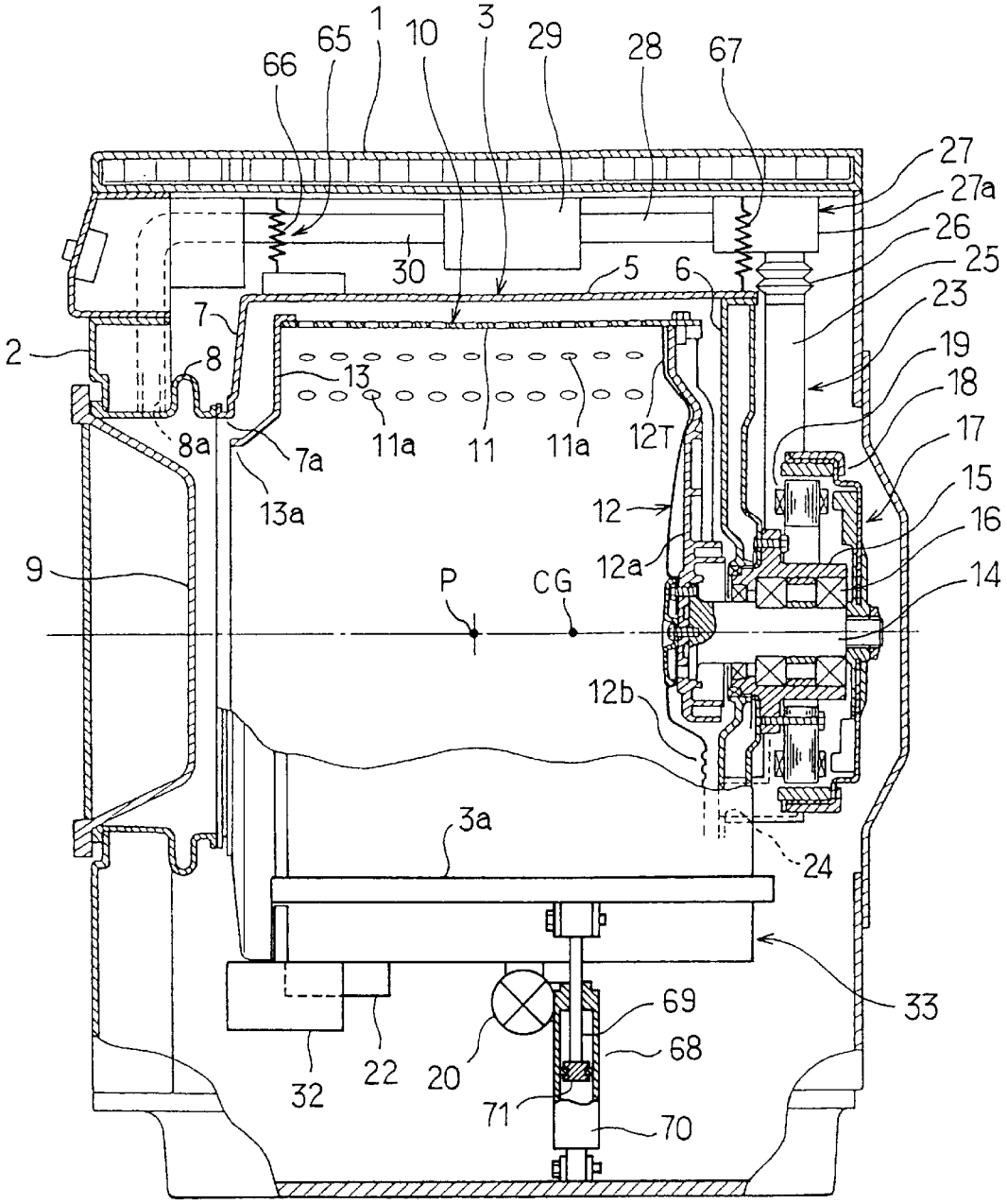
FIG. 11 is a view similar to FIG. 1, showing the drum type washing machine of a seventh embodiment in accordance with the invention.
Figure 12:
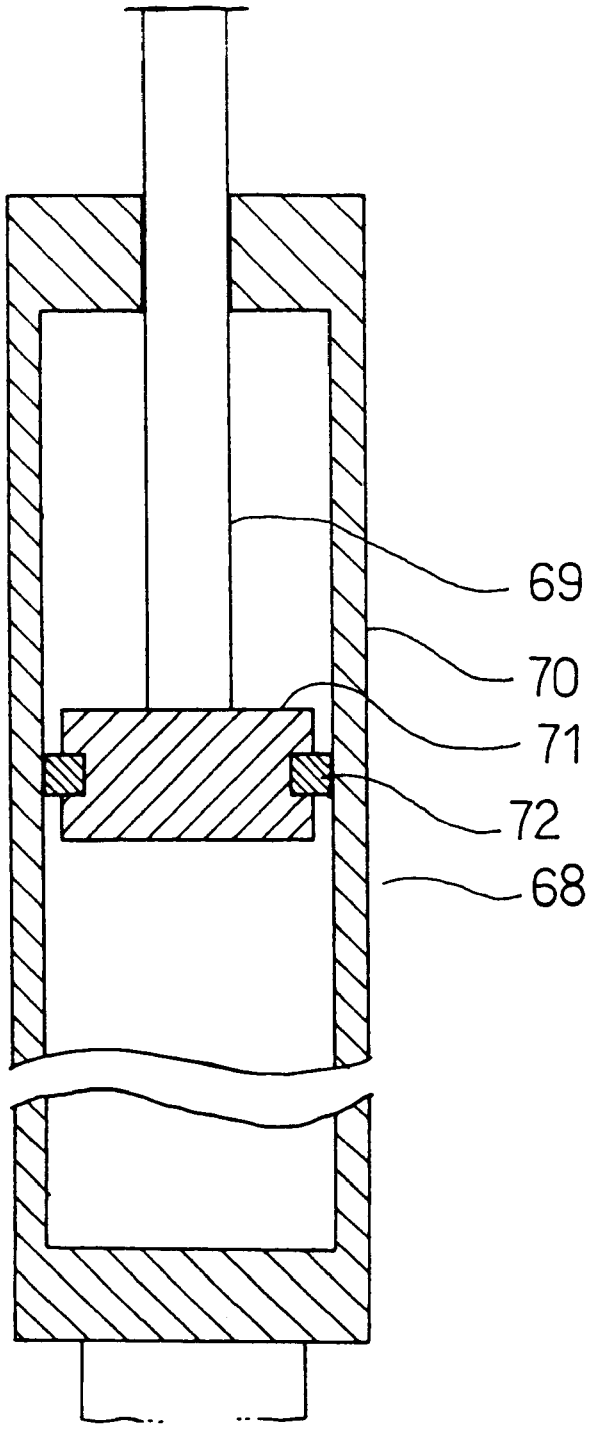
FIG. 12 is a longitudinally sectional side view of a damper.

FIGS. 11 and 12 illustrate a seventh embodiment of the invention. Only the difference between the second and seventh embodiments will be described. In the seventh embodiment, the elastic supporting element comprises two tension coil springs 66 and 67 provided on the front top and the rear top of the water tub 3 respectively and a pair of dampers 68 provided between the lower portion of the water tub 3 and the bottom of the casing 1. The tension coil springs 66 and 67 have respective upper ends fixed to the inner face of the top of the casing 1. A distance between the spring 66 and the center of gravity CG of the loading element 33 is shorter than a distance between the spring 67 and the center of gravity CG. The spring 66 serves as the front supporting member and the spring 67 serves as the rear supporting member. The spring 66 has a smaller spring constant than the spring 67 so that the water tub 3 is maintained substantially in the horizontal state.

Each damper 68 comprises a cylinder 70 and a rod 69 having a lower portion inserted into the cylinder. The rod 69 includes an upper end connected to the support 3*a* provided on the lower portion of the water tub 3. The cylinder 70 of each damper 68 stands on the bottom of the casing 1. A rod head 71 is mounted on a lower end of the rod 69. A sliding ring 72 made of rubber, for example, is attached to an outer circumference of the rod head 71.

The water tub 3 is suspended from the springs 66 and 67 in the seventh embodiment. Each damper 68 has a function of damping the vibration of the loading element 33 such as the water tub 3 and a function of preventing back-and-forth movement of the water tub. The other construction of the drum type washing machine of the seventh embodiment is the same as of the second embodiment. Consequently, the same effect can be achieved from the seventh embodiment as from the second embodiment.

Figure 13:
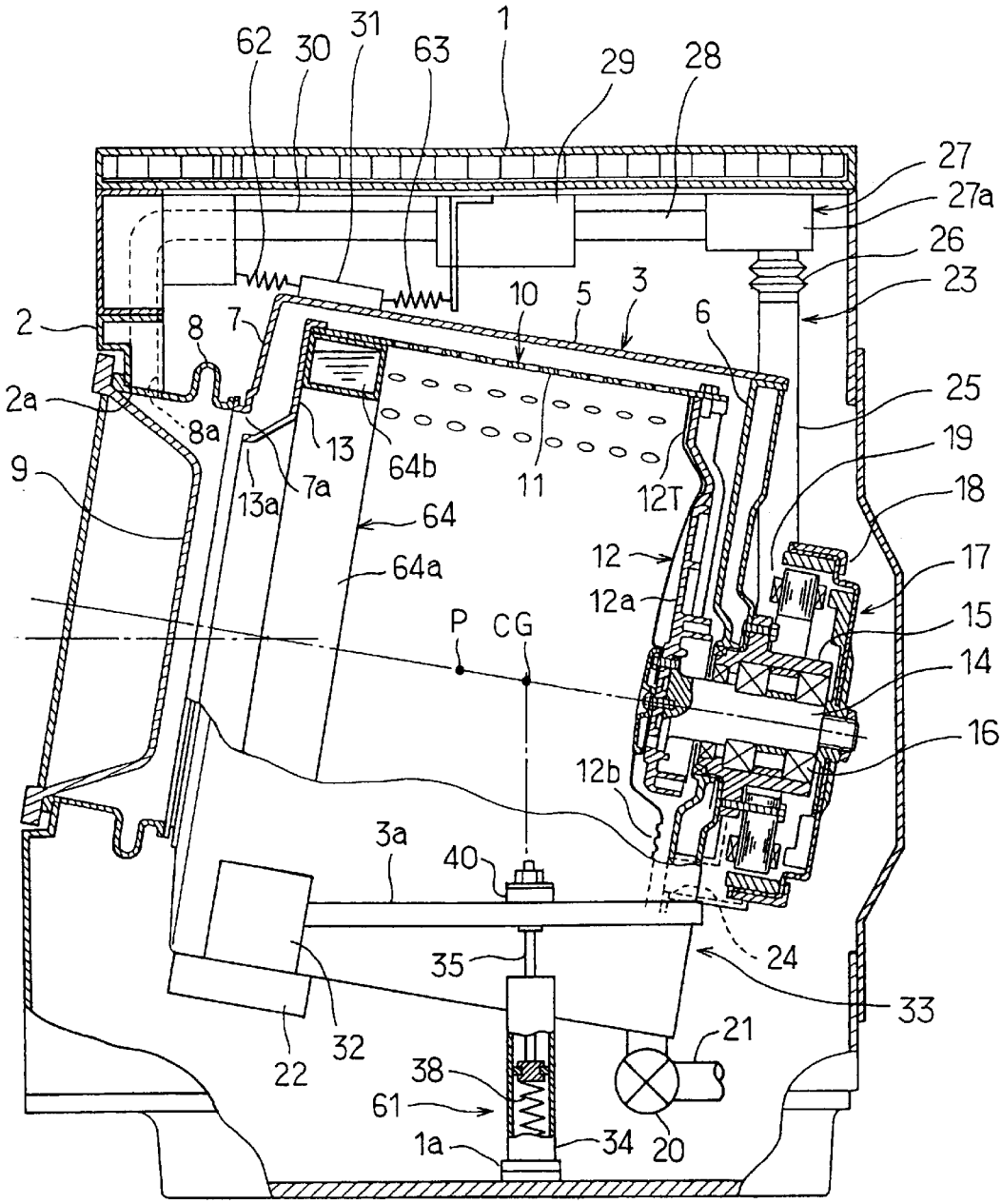
FIG. 13 is a view similar to FIG. 1, showing the drum type washing machine of an eighth embodiment in accordance with the invention.
Figure 14:
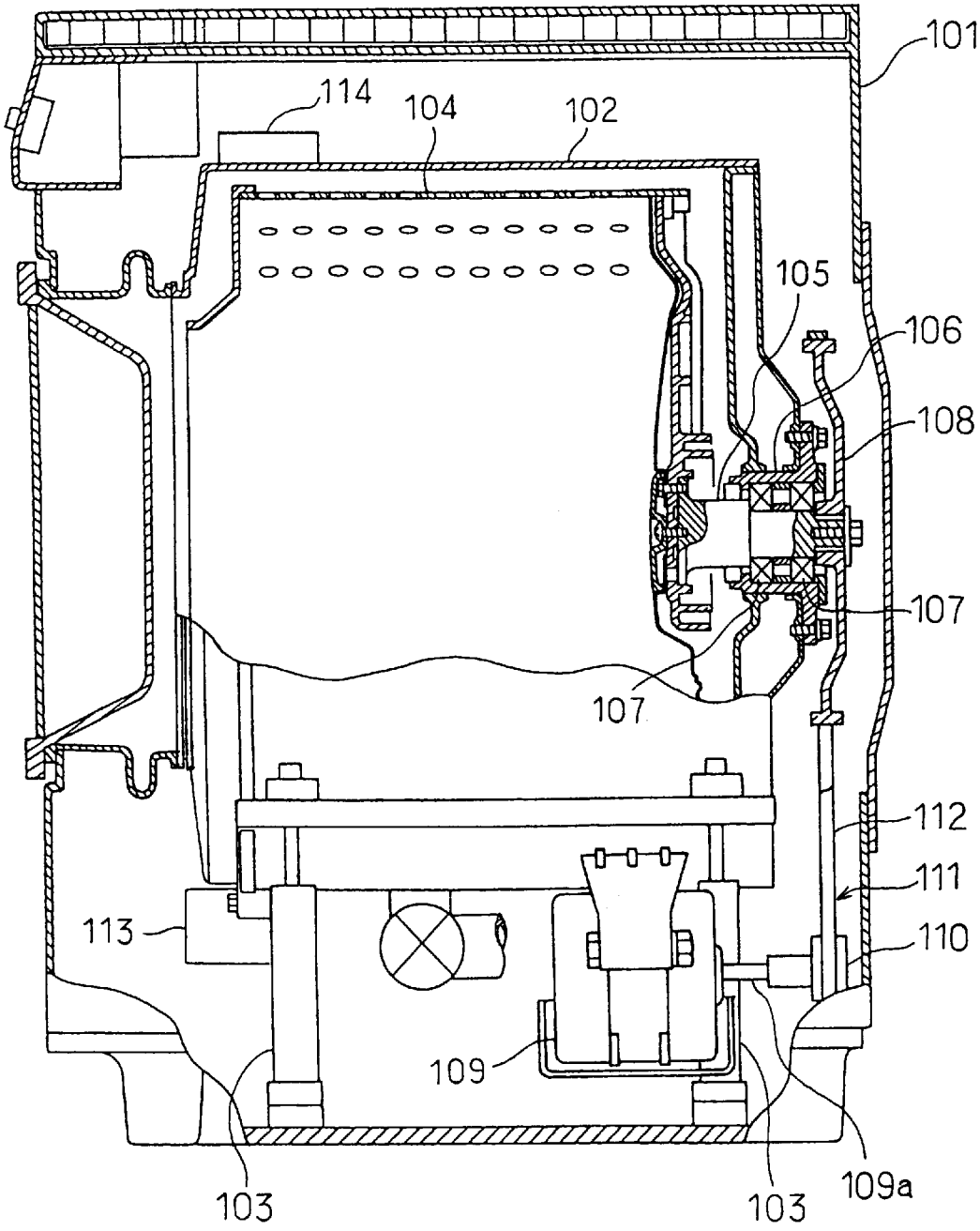
FIG. 14 is a longitudinally sectional side view of a conventional drum type washing machine.

FIG. 13 illustrates an eighth embodiment of the invention. Only the difference between the sixth and eighth embodiments will be described. In the eighth embodiment, the water tub 3 is disposed rearwardly downward. The rotating tub 10 has an axis of rotation inclined rearwardly downward relative to a horizontal axis. A pair of generally horizontally extending supports 3*a* are fixed to the opposite sides of the lower portion of the water tub 3. Each suspension mechanism 61 has an upper end mounted to the support 3*a*. The mounting location of each suspension mechanism 61 on the support 3*a* is set to agree with the center of gravity CG of the loading element 33. Two tension coil springs 62 and 63 are provided on the front top of the water tub 3.

The laundry accommodated in the rotating tub 10 is one-sided to the rear interior of the tub since it is inclined rearwardly downward. Further, the center of gravity CG of the loading element 33 is located in the rear of the middle of the back-and-forth dimension of the rotating tub 10. Accordingly, the center of gravity CG of the loading element 33 does not vary so much even when laundry is accommodated in the rotating tub 10. This means that the balance in the weight of the loading element 33 is not affected so much by the weight of the laundry accommodated in the rotating tub 10. Consequently, the vibration produced during rotation of the rotating tub 10 can be reduced.

In the foregoing third embodiment, the compression coil springs have the free lengths different from each other so that the suspension mechanisms 4A and 4B have the constructions differing from each other. For the same purpose, however, the compression coil springs may have spring constants differing from each other, instead. More specifically, where symbol ka designates a spring constant of the compression coil spring of the front suspension mechanism and symbol kb designates a spring constant of the compression coil spring of the rear suspension mechanism, the spring constants of the springs of the suspension mechanisms 4A and 4B are set so that a ratio Da of load Wa applied to the front suspension mechanism 4A to the spring constant ka is substantially equal to a ratio Db of load Wb applied to the rear suspension mechanism 4B to the spring constant kb. As a result, the water tub 3 can be maintained in the horizontal state by the suspension mechanisms 4A and 4B. Moreover, when the ratios Da and Db are substantially equal to each other, the rotational speeds of the rotating tub 10 at which the suspension mechanisms 4A and 4B resonate during rotation of the rotating tub respectively are substantially the same. In other words, since both suspension mechanisms 4A and 4B resonate at one and the same rotational speed, the number of times of resonance is reduced to one. Consequently, the vibration of the water tub 3 due to rotation of the rotating tub 10 can be reduced.

Further, both of the spring constants and free lengths of the compression coil springs may be changed for different constructions of the suspension mechanisms 4A and 4B.

Although the water tub 3 is held substantially horizontally in each of the second and third embodiments, it may be held to be inclined rearwardly downward.

The balancer 64 may contain a multitude of small balls in the container, instead of water.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A drum type washing machine comprising:

an outer cabinet;

a water tub provided in the outer cabinet;

a drum type rotating tub provided for rotation in the water tub, the rotating tub having a front and a rear;

an electric motor driving the rotating tub;

an elastic supporting element elastically supporting the water tub; and a loading element loading the supporting element and having a center of gravity located between substantially the middle of a dimension from the front to the rear of the rotating tub and the rear of the rotating tub, wherein the elastic supporting element includes a pair of front supporting members disposed ahead of the center of gravity of the loading element and a pair of rear supporting members disposed in the rear of the center of gravity of the loading element, and a distance from each front supporting member to the center of gravity of the loading element is substantially equal to a distance from each rear supporting member to the center of gravity of the loading element.

2. The drum type washing machine according to claim 1, further comprising a bearing assembly provided on the rear of the water tub for supporting the rotating tub for rotation, wherein the loading element at least includes the water tub, rotating tub, bearing assembly and motor.

3. The drum type washing machine according to claim 1, wherein either the water tub or the rotating tub is provided with a counterweight disposed ahead of substantially the middle of the dimension from the front to the rear of the rotating tub.

4. The drum type washing machine according to claim 1, further comprising a balancer provided on the front of the rotating tub.

5. The drum type washing machine according to claim 1, wherein the rotating tub has an axis of rotation inclined rearwardly downward relative to a horizontal axis.

6. A drum type washing machine comprising:

an outer cabinet;

a water tub provided in the outer cabinet;

a drum type rotating tub provided for rotation in the water tub, the rotating tub having a front and a rear;

an electric motor driving the rotating tub;

an elastic supporting element elastically supporting the water tub; and a loading element loading the supporting element and having a center of gravity located between substantially the middle of a dimension from the front to the rear of the rotating tub and the rear of the rotating tub, wherein the elastic supporting element includes a pair of front supporting members disposed ahead of the center of gravity of the loading element and a pair of rear supporting members disposed in the rear of the center of gravity of the loading element, and a distance from each front supporting member to the center of gravity of the loading element is substantially longer than a distance from each rear supporting member to the center of gravity of the loading element.

7. The drum type washing machine according to claim 6, further comprising a first fixing member to which the front supporting member is fixed and a second fixing member to which the rear supporting member is fixed, wherein a mounting dimension from the first fixing member to a portion of each front supporting member on which the water tub is supported differs from a mounting dimension from the second fixing member to a portion of each rear supporting member on which the water tub is supported.

8. The drum type washing machine according to claim 6, wherein each front supporting member includes a first spring to which the load of the loading element is applied, each rear supporting member includes a second spring to which the load of the loading element is applied, and each first spring has a free length differing from a free length of each second spring.

9. The drum type washing machine according to claim 6, wherein each front supporting member includes a first spring to which the load of the loading element is applied, each rear supporting member includes a second spring to which the load of the loading element is applied, and each first spring has a spring constant differing from a spring constant of each second spring.

10. The drum type washing machine according to claim 6, further comprising a bearing assembly provided on the rear of the water tub for supporting the rotating tub for rotation, wherein the loading element at least includes the water tub, rotating tub, bearing assembly and motor.

11. The drum type washing machine according to claim 6, wherein either the water tub or the rotating tub is provided with a counterweight disposed ahead of substantially the middle of the dimension from the front to the rear of the rotating tub.

12. The drum type washing machine according to claim 6, further comprising a balancer provided on the front of the rotating tub.

13. The drum type washing machine according to claim 6, wherein the rotating tub has an axis of rotation inclined rearwardly downward relative to a horizontal axis.

14. A drum type washing machine comprising:

an outer cabinet;

a water tub provided in the outer cabinet;

a drum type rotating tub provided for rotation in the water tub, the rotating tub having a front and a rear;

an electric motor driving the rotating tub;

an elastic supporting element elastically supporting the water tub; and a loading element loading the supporting element and having a center of gravity located between substantially the middle of a dimension from the front to the rear of the rotating tub and the rear of the rotating tub, wherein the elastic supporting element includes a pair of the elastic supporting elements including respective portions on which the water tub is supported, the portions being located ahead of the center of gravity of the loading element between the center of gravity of the loading element and another center of gravity of the loading element in a case where an allowable maximum amount of laundry is accommodated in the rotating tub.

15. The drum type washing machine according to claim 14, further comprising a bearing assembly provided on the rear of the water tub for supporting the rotating tub for rotation, wherein the loading element at least includes the water tub, rotating tub, bearing assembly and motor.

16. The drum type washing machine according to claim 14, wherein either the water tub or the rotating tub is provided with a counterweight disposed ahead of substantially the middle of the dimension from the front to the rear of the rotating tub.

17. The drum type washing machine according to claim 14, further comprising a balancer provided on the front of the rotating tub.

18. The drum type washing machine according to claim 14, wherein the rotating tub has an axis of rotation inclined rearwardly downward relative to a horizontal axis.

* * * * *

UNITED STATES PATENT AND TRADEMARK OFFICE

CERTIFICATE OF CORRECTION

PATENT NO. : 6,557,383 B1
DATED : May 6, 2003
INVENTOR(S) : Masumi Ito et al.

It is certified that error appears in the above-identified patent and that said Letters Patent is hereby corrected as shown below:

Title page,
Item [57], ABSTRACT, please replace the paragraph as follows:

-- A drum type washing machine includes an outer cabinet, a water tub mounted in the outer cabinet, a drum type rotating tub mounted for rotation in the water tub, an electric motor driving the rotating tub, an elastic supporting element elastically supporting the water tub, and a loading element loading the supporting element and having a center of gravity located between substantially the middle of a dimension from the front to the rear of the rotating tub and the rear of the rotating tub. The elastic supporting element includes a pair of front supporting members disposed ahead of the center of gravity of the loading element and a pair of rear supporting members disposed in the rear of the center of gravity of the loading element. A distance from each front supporting member to the center of gravity of the loading element is substantially equal to a distance from each rear supporting member to the center of gravity of the loading element.--.

Signed and Sealed this

Ninth Day of March, 2004

JON W. DUDAS
*Acting Director of the United States Patent and Trademark Office*